US011587757B2

(12) United States Patent
Parker et al.

(10) Patent No.: US 11,587,757 B2
(45) **Date of Patent: *Feb. 21, 2023**

(54) X-RAY TUBE INSULATION, WINDOW, AND FOCUSING PLATE

(71) Applicant: Moxtek, Inc., Orem, UT (US)

(72) Inventors: Todd S. Parker, Kaysville, UT (US); Eric Miller, Provo, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/477,022

(22) Filed: Sep. 16, 2021

(65) Prior Publication Data

US 2022/0013321 A1 Jan. 13, 2022

Related U.S. Application Data

(63) Continuation of application No. 16/937,307, filed on Jul. 23, 2020, now Pat. No. 11,152,184.

(60) Provisional application No. 62/883,242, filed on Aug. 6, 2019.

(51) Int. Cl.

| | |
|---|---|
| ***H01J 35/18*** | (2006.01) |
| ***H01J 35/14*** | (2006.01) |
| ***H01J 35/06*** | (2006.01) |
| ***H01J 35/08*** | (2006.01) |

(52) U.S. Cl.

CPC ..... *H01J 35/186* (2019.05); *H01J 35/066* (2019.05); *H01J 35/116* (2019.05); *H01J 35/14* (2013.01); *H01J 35/18* (2013.01); *H01J 2235/166* (2013.01); *H01J 2235/18* (2013.01)

(58) Field of Classification Search

CPC ..... H01J 35/186; H01J 35/116; H01J 35/18; H01J 2235/18

See application file for complete search history.

(56) References Cited

U.S. PATENT DOCUMENTS

| | | | | |
|---|---|---|---|---|
| 11,081,311 | B2 * | 8/2021 | Parker | H01J 35/12 |
| 11,152,184 | B2 * | 10/2021 | Parker | H01J 35/116 |
| 2007/0237302 | A1 * | 10/2007 | Chen | H01J 35/066 378/136 |
| 2008/0170668 | A1 * | 7/2008 | Kruit | H01J 35/12 378/141 |
| 2010/0079053 | A1 * | 4/2010 | Andrews | H01J 3/027 313/326 |

(Continued)

*Primary Examiner* — Chih-Cheng Kao

(74) *Attorney, Agent, or Firm* — Thorpe North & Western, LLP

(57) ABSTRACT

X-ray transparent insulation can be sandwiched between an x-ray window and a ground plate. The x-ray transparent insulation can include aluminum nitride, boron nitride, or polyetherimide. The x-ray transparent insulation can include a curved side. The x-ray transparent insulation can be transparent to x-rays and resistant to x-ray damage, and can have high thermal conductivity. An x-ray window can have high thermal conductivity, high electrical conductivity, high melting point, low cost, and matched coefficient of thermal conductivity with the anode. The x-ray window can be made of tungsten. For consistent x-ray spot size and location, a focusing plate and a filament can be attached to a cathode with an open channel of the focusing plate aligned with a longitudinal dimension of the filament. Tabs of the focusing plate bordering the open channel can be bent to align with a location of the filament.

18 Claims, 4 Drawing Sheets

(56) References Cited

U.S. PATENT DOCUMENTS

| | | | | |
|---|---|---|---|---|
| 2012/0051496 | A1* | 3/2012 | Wang | H01J 35/186 378/124 |
| 2012/0318987 | A1* | 12/2012 | Miyazaki | H01J 35/18 250/358.1 |
| 2013/0016811 | A1 | 1/2013 | Ueda et al. | |
| 2013/0235975 | A1 | 9/2013 | Tamura et al. | |
| 2017/0287673 | A1 | 10/2017 | Peterson et al. | |
| 2017/0323759 | A1 | 11/2017 | Wall | |
| 2020/0211808 | A1 | 7/2020 | Ando | |

* cited by examiner

X-RAY TUBE INSULATION, WINDOW, AND FOCUSING PLATE

CLAIM OF PRIORITY

This is a continuation of U.S. nonprovisional patent application Ser. No. 16/937,307, filed on Jul. 23, 2020, which claims priority to U.S. Provisional Patent Application No. 62/883,242, filed on Aug. 6, 2019, which are incorporated herein by reference.

FIELD OF THE INVENTION

The present application is related generally to x-ray sources.

BACKGROUND

X-ray tubes can include electrical insulation. Useful characteristics of such insulation can include proper x-ray transmissivity (high or low), resistance to x-ray damage, high electrical resistivity, and high thermal conductivity.

In a transmission-target x-ray tube, the x-ray window can include a target material for generation of x-rays, and also another material, such as beryllium, for structural support. Useful characteristics of such x-ray windows include high thermal conductivity, high electrical conductivity, high melting point, low cost, and matching x-ray window coefficient of thermal expansion with the structure to which it is mounted.

X-ray tubes can include an electron emitter, such as a filament. Repeated, precise placement of the filament can result in consistent x-ray spot size and location, which can be helpful for users of the x-ray tubes. Due to the small size of filaments, particularly in miniature x-ray tubes, such repeated, precise placement of filaments can be difficult. It would be useful to have consistent x-ray spot size and location in spite of the difficulty of repeated, precise placement of filaments.

BRIEF DESCRIPTION OF THE DRAWINGS (DRAWINGS MIGHT NOT BE DRAWN TO SCALE)

Figure 1:
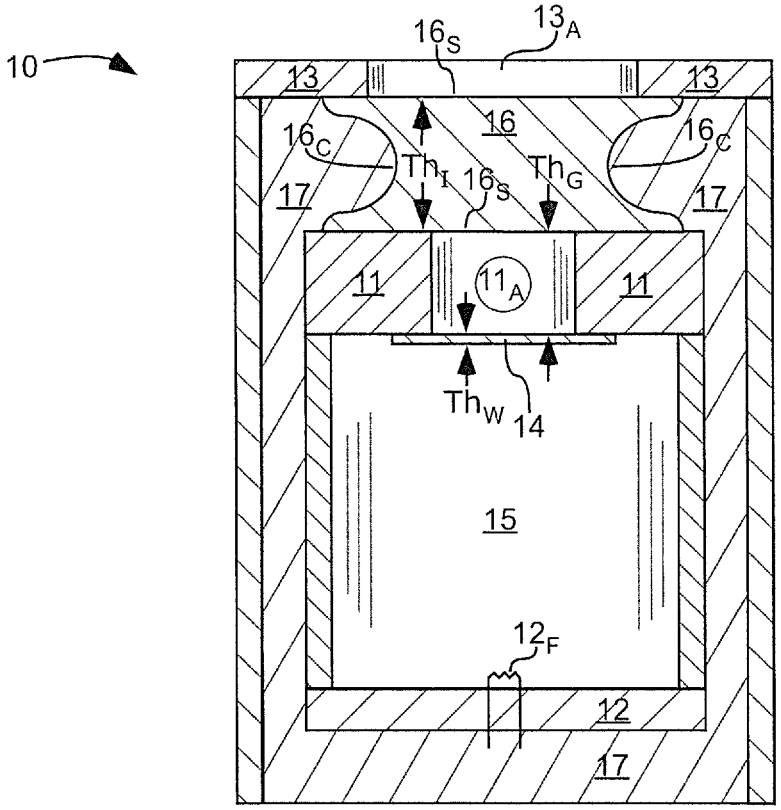

FIG. 1 is a schematic, cross-sectional side-view of an x-ray tube 10 comprising: an anode 11 sandwiched between a cathode 12 and a ground plate 13; an x-ray window 14 located across an aperture $\mathbf{11}_A$ of the anode 11, and hermetically sealed to the anode 11; and x-ray transparent insulation 16, with a curved side $\mathbf{16}_C$, between the x-ray window 14 and the aperture $\mathbf{13}_A$ of the ground plate 13; in accordance with an embodiment of the present invention.

Figure 2:
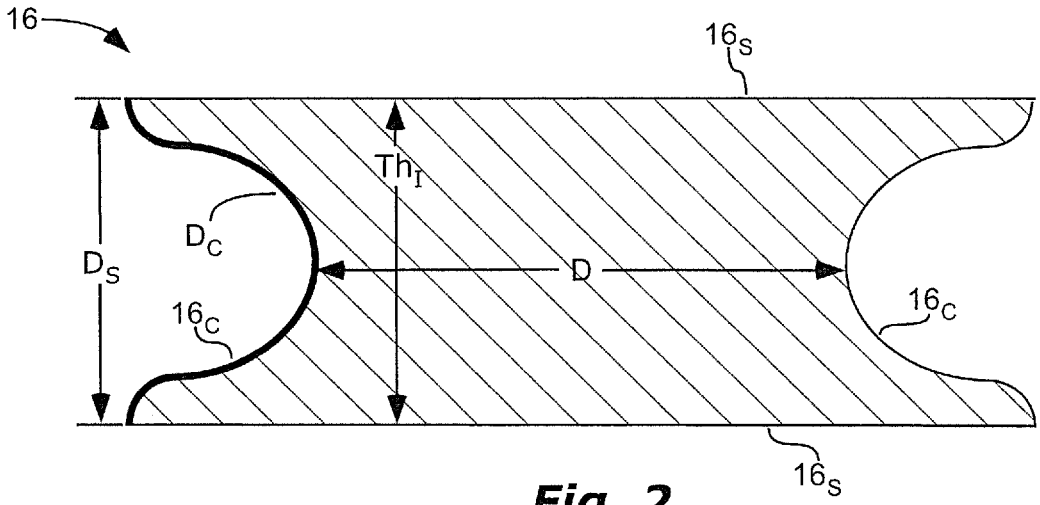

FIG. 2 is a schematic, cross-sectional side-view of x-ray transparent insulation 16, including two opposite sides $\mathbf{16}_S$, one of the opposite sides $\mathbf{16}_S$ configured to face the x-ray window 14 and another of the opposite sides $\mathbf{16}_S$ configured to face the ground plate 13, and a curved side $\mathbf{16}_C$ extending between the two opposite sides $\mathbf{16}_S$, in accordance with an embodiment of the present invention.

Figure 3:
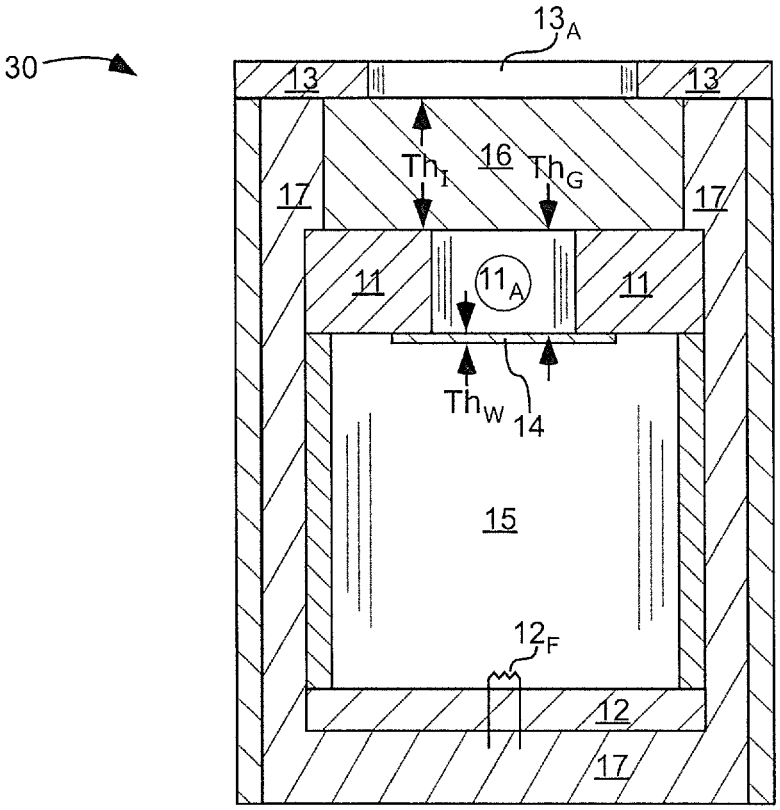

FIG. 3 is a schematic, cross-sectional side-view of an x-ray tube 30, similar to x-ray tube 10, except that the x-ray transparent insulation 16 of x-ray tube 30 lacks the curved side $\mathbf{16}_C$, in accordance with an embodiment of the present invention.

Figure 4:
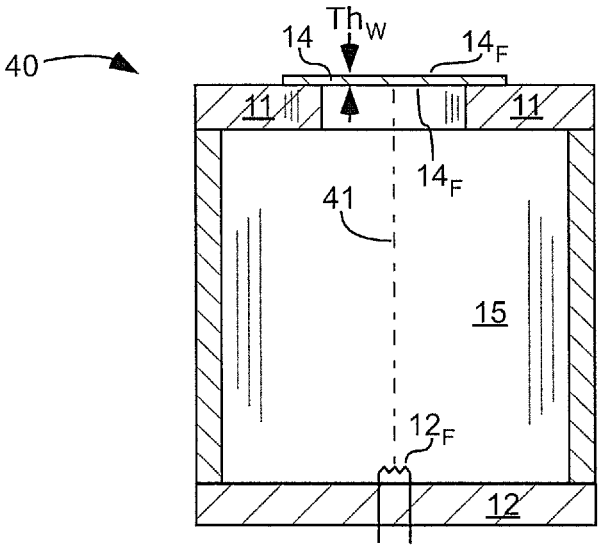

FIG. 4 is a schematic, cross-sectional side-view of an x-ray tube 30 comprising an anode 11, a cathode 12, and an x-ray window 14, in accordance with an embodiment of the present invention.

Figure 5:
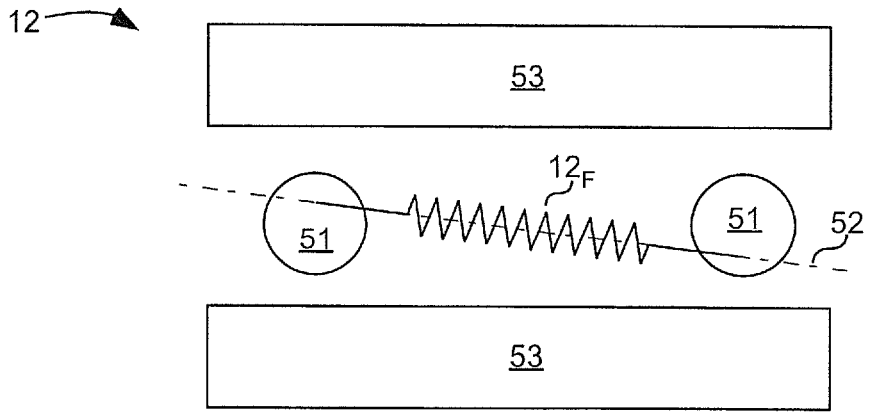

FIG. 5 is a schematic, top-view of a cathode 12 with a misaligned filament $\mathbf{12}_F$ electrically coupled between a pair of electrodes 51, in accordance with an embodiment of the present invention.

Figure 6:
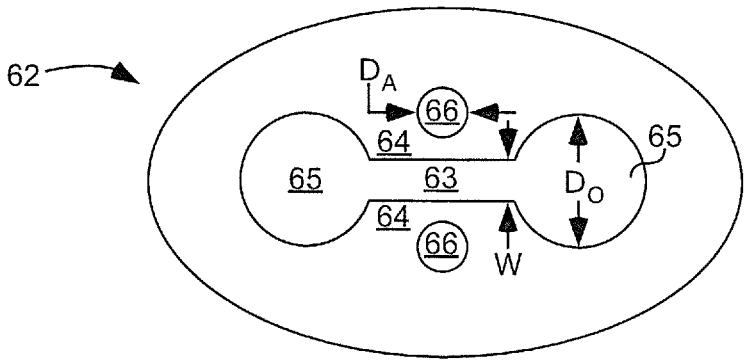

FIG. 6 is a schematic, top-view of a focusing plate 62 including an open channel 63 extending between two open holes 65, and tabs 64 bordering the open channel 63, in accordance with an embodiment of the present invention.

Figure 7:
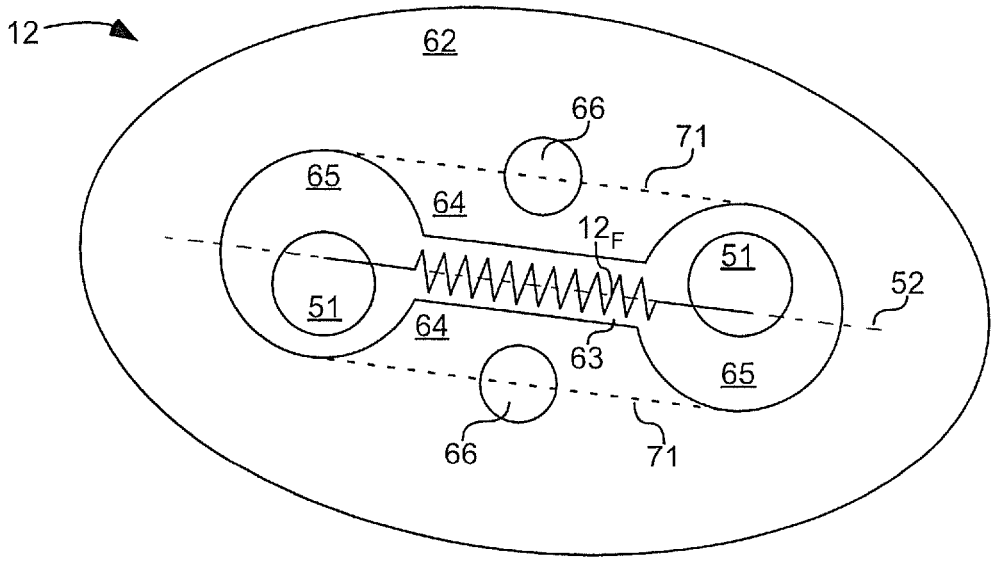

FIG. 7 is a schematic, top-view of a cathode 12 with the open channel 63 of the focusing plate 62 aligned with a longitudinal dimension 52 of the filament $\mathbf{12}_F$, in accordance with an embodiment of the present invention.

Figure 8:
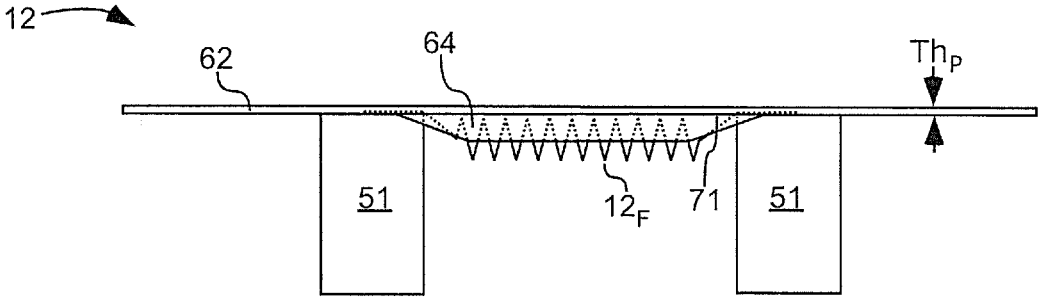

FIG. 8 is a schematic, side-view of a cathode 12 with tabs 64 of the focusing plate 62 bent along line 71 to align with a location of the filament $\mathbf{12}_F$, in accordance with an embodiment of the present invention.

Figure 9:
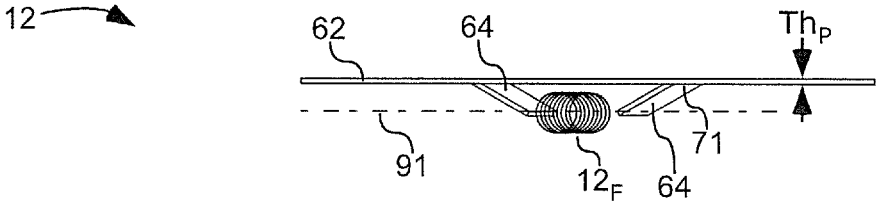

FIG. 9 is a schematic, end-view of a cathode 12 with tabs 64 of the focusing plate 62 bent along line 71 to align with a location of the filament $\mathbf{12}_F$, such that an imaginary plane 91, extending between an edge of the tabs 64 at the open channel 63, extends through the filament $\mathbf{12}_F$, in accordance with an embodiment of the present invention.

DEFINITIONS. The following definitions, including plurals of the same, apply throughout this patent application.

As used herein, the terms "align", "aligned", and "aligning" refer to exact alignment, alignment within normal manufacturing tolerances, or near exact alignment, such that any deviation from exact alignment would have negligible effect for ordinary use of the device.

As used herein, the term "identical" means exactly identical, identical within normal manufacturing tolerances, or close to identical, such that any deviation from exactly identical would have negligible effect for ordinary use of the device.

As used herein, the term "kV" means kilovolt(s).

As used herein, the term "mm" means millimeter(s).

As used herein, the term "x-ray tube" is not limited to tubular/cylindrical shaped devices. The term "tube" is used because this is the standard term used for x-ray emitting devices.

Unless explicitly noted otherwise herein, all temperature-dependent values are such values at 25° C.

DETAILED DESCRIPTION

X-Ray Transparent Insulation 16

As illustrated in FIG. 1, an x-ray tube 10 is shown comprising an anode 11 sandwiched between, and electrically isolated from, a cathode 12 and a ground plate 13. The anode 11 can be attached to a large, positive bias voltage, such as for example ≥1 kV, ≥10 kV, ≥25 kV, or ≥50 kV. An x-ray window 14 can be located across an aperture $\mathbf{11}_A$ of the anode 11, and hermetically sealed to the anode 11. An aperture $\mathbf{13}_A$ of the ground plate 13 can be aligned with the x-ray window 14 (i.e. aligned for transmission of x-rays out of the x-ray tube 10).

X-ray transparent insulation 16 can be sandwiched between the x-ray window 14 and the aperture $\mathbf{13}_A$ of the ground plate 13. The x-ray transparent insulation 16 can electrically insulate the x-ray window 14 from the ground plate 13. The x-ray transparent insulation 16 can include two opposite sides $\mathbf{16}_S$. One of the two opposite sides $\mathbf{16}_S$ can face the x-ray window 14 and the other of the two opposite sides $\mathbf{16}_S$ can facing the ground plate 13. A curved side $\mathbf{16}_C$ can extend between the two opposite sides $\mathbf{16}_S$. The curved side $\mathbf{16}_C$ of the x-ray transparent insulation 16 can be encircled by or surrounded by x-ray opaque insulation 17. The x-ray transparent insulation 16 likely will block or attenuate some x-rays and the x-ray opaque insulation 17 likely will transmit some x-rays; thus, the terms "transparent" and "opaque" are relative. It can be helpful for x-rays emitted in desired directions (e.g. through the x-ray window 14 and through the aperture $\mathbf{13}_A$ of the ground plate 13) to pass through the x-ray transparent insulation 16, and for x-rays emitted in undesirable directions to be blocked by the x-ray opaque insulation 17.

The curved side $\mathbf{16}_C$ can be shaped for transmission of x-rays in desired directions and for the x-ray opaque insulation 17 to block x-rays transmitted in undesired directions. For example, as illustrated in FIGS. 1-2, the curved side $\mathbf{16}_C$ can curve inward, reducing a diameter D of the x-ray transparent insulation 16. The curved side $\mathbf{16}_C$ can curve inward at each of the two opposite sides $\mathbf{16}_S$. In one aspect, the curved side $\mathbf{16}_C$ can be formed by a concave groove circumscribing a perimeter side of the x-ray transparent insulation 16. In another aspect, an outer edge of the groove can have a fillet with a concave radius between the groove and the perimeter side. The x-ray opaque insulation 17 can have an annular flange with a concave profile to match the curved side $\mathbf{16}_C$ of the x-ray transparent insulation 16.

The curved side $\mathbf{16}_C$ can be shaped to increase a distance an arc must travel for a short circuit between the anode 11 and the ground plate 13. As illustrated in FIGS. 1-2, the curved side $\mathbf{16}_C$ can include a curved shape. Example relationships, between a shortest distance $D_C$ along the curved shape and a shortest straight-line distance $D_S$, between outer edges of the two opposite sides $\mathbf{16}_S$, include: $D_C \geq 1.1*D_S$, $D_C \geq 1.3*D_S$, $D_C \geq 1.5*D_S$, or $D_C \geq 1.6*D_S$; and $D_C \leq 10*D_S$, $D_C \leq 100*D_S$, or $D_C \leq 1000*D_S$.

The x-ray transparent insulation 16 can have a thickness $Th_I$ sufficient for voltage standoff while also minimizing x-ray attenuation. For example, $Th_I \geq 0.5$ mm, $Th_I \geq 1$ mm, $Th_I \geq 2$ mm, or $Th_I \geq 3$ mm; and $Th_I \leq 6$ mm, $Th_I \leq 7$ mm, or $Th_I \leq 8$ mm, where $Th_I$ is a thickness of the x-ray transparent insulation 16 between the two opposite sides $\mathbf{16}_S$. Thus, the shortest distance $D_C$ along the curved shape can be greater than the thickness $Th_I$ of the x-ray transparent insulation 16.

There can be a gap between the x-ray transparent insulation 16 and the x-ray window 14 to minimize heat transfer from the x-ray window 14 to the x-ray transparent insulation 16. The gap can be free of solid material. Example thicknesses ($Th_G$) of the gap include $Th_G \geq 0.5$ mm, $Th_G \geq 1$ mm, or $Th_G \geq 2$ mm; and $Th_G \leq 4$ mm, $Th_G \leq 5$ mm, $Th_G \leq 6$ mm, $Th_G \leq 10$ mm.

Illustrated in FIG. 3 is x-ray tube 30, similar to x-ray tube 10, except that in x-ray tube 30, the x-ray transparent insulation 16 lacks the curved side $\mathbf{16}_C$, which might be preferable in some embodiments due to lower manufacturing cost. The x-ray transparent insulation 16 can be a cylindrical disc.

Material of the x-ray transparent insulation 16 can be selected based on minimal attenuation of x-rays, resistance to x-ray damage, electrical resistivity, and thermal conductivity. Example materials for the x-ray transparent insulation 16 include aluminum nitride, boron nitride, polyetherimide, or combinations thereof. A material composition of the x-ray window 14 can be identical throughout the x-ray window 14.

X-Ray Window

As illustrated in FIGS. 1, 3, and 4 x-ray tubes 10, 30, and 40 can include a cathode 12 and an anode 11 electrically insulated from one another. An x-ray window 14 can be located across an aperture $\mathbf{11}_A$ of the anode 11, and hermetically sealed to the anode 11. The cathode 12 can be configured to emit electrons towards the x-ray window 14. The x-ray window 14 can have high thermal conductivity, high electrical conductivity, high melting point, low cost, matching coefficient of thermal expansion with the anode 11, or combinations thereof.

The x-ray window 14 can include a target material for generating x-rays in response to impinging electrons from the cathode. The target material can be spread throughout, and can be spread evenly throughout, the entire x-ray window. The entire x-ray window 14 can be the target material. The x-ray window 14 can be free of beryllium. A material composition of the x-ray window 14 can be identical throughout the x-ray window 14. The x-ray window 14 can have a homogeneous material composition. Instead of being multiple layers of different materials, the x-ray window 14 can be a single layer of material, which can improve the x-ray window 14 durability by avoiding separate layers with different coefficient of thermal expansion.

The x-ray window 14 can be made mostly or totally of a single element. The single element can be molybdenum, rhodium, rhenium, or tungsten. For example, a mass percent of the single element in the x-ray window 14 can be ≥75%, ≥90%, ≥95%, ≥99%, or ≥99.5%. The x-ray window 14 can include two opposite faces $\mathbf{14}_F$, each opposite face $\mathbf{14}_F$ exposed to air, another gas, or vacuum. A material composition at each of two opposite faces $\mathbf{14}_F$ can include a mass percent of the single element that is ≥75%, ≥90%, ≥95%, ≥99%, or ≥99.5%.

The x-ray window 14 can include additional elements, which can improve the properties of the single element. For example, aluminum, potassium, silicon, or combinations thereof, can be added for smaller grain structure and reduced fatigue cracking. The x-ray window 14 can include lanthanum oxide for improved machinability.

In order to reduce thermal stress in the x-ray window 14, a material composition of the x-ray window 14 and a material composition of the anode 11 can be similar or can be the same. For example, a mass percent of tungsten in the x-ray window 14 and the anode 11, or a portion of the anode 11 to which the x-ray window 14 is attached, can be ≥75%, ≥90%, ≥95%, ≥99%, or ≥99.5%.

The x-ray window 14 can have a thickness $Th_W$ designed for sufficient strength, optimal heat transfer, and emission of x-rays. For example, $Th_W \geq 0.001$ mm, $Th_W \geq 0.005$ mm, $Th_W \geq 0.01$ mm, or $Th_W \geq 0.025$ mm; and $Th_W \leq 0.051$ mm, $Th_W \leq 0.08$ mm, $Th_W \leq 0.1$ mm, or $Th_W \leq 0.2$ mm.

Focusing Plate 62

As illustrated on cathode 12 in FIG. 5, a filament $\mathbf{12}_F$ can be electrically coupled across a pair of electrodes 51. The electrodes 51 can be part of the x-ray tube cathode 12. Cathode optics 53 can shape the electron beam emitted by the filament $\mathbf{12}_F$. Due to the small size of the filament $\mathbf{12}_F$, it can be difficult to repeatedly align the filament $\mathbf{12}_F$ with cathode optics 53 during manufacturing of the x-ray tubes. A focusing plate 62 as described below, and illustrated in FIGS. 6-9, can shape the electron beam. The focusing plate 62 can be spaced apart from the filament $\mathbf{12}_F$. The focusing plate 62 can include an open channel 63.

The open channel 63 of the focusing plate 62 can extend between two open holes 65 in the focusing plate 62. The two open holes 65 can be aligned with the pair of electrodes 51, each open hole 65 being aligned with one of the electrodes 51. Following are example relationships between a smallest diameter $D_O$ of the two open holes 65 and a width W of the channel, for shaping of the electron beam: $D_O/W \geq 1$, $D_O/W \geq 1.5$, $D_O/W \geq 2$, or $D_O/W \geq 2.5$; and $D_O/W \leq 4.5$, $D_O/W \leq 6$, $D_O/W \leq 7$, $D_O/W \leq 10$; the width W being perpendicular to the longitudinal dimension 52 of the filament $\mathbf{12}_F$.

In addition to variation of placement of the filament $\mathbf{12}_F$ diagonally across the electrodes 51, there can also be variation of placement of the filament $\mathbf{12}_F$ vertically, i.e. in a direction parallel to an axis 41 (see FIG. 4) of the x-ray tube 40 extending between the filament $\mathbf{12}_F$ and a target material on the anode 11 or x-ray window 14.

The focusing plate 62 can include tabs 64 bordering the open channel 63. As illustrated in FIGS. 7-8, the tabs 64 of the focusing plate 62 can be bent along line 71 to align edges of the tabs 64 with a location of the filament $\mathbf{12}_F$, to help focus the electrons and to create the desired focal shape. The tabs 64 can be bent so that an imaginary plane 91 extends between an edge of the tabs 64 at the open channel 63 and through the filament $\mathbf{12}_F$. The tabs 64 can be bent along line 71 to align with the filament $\mathbf{12}_F$ after attaching the focusing plate 62 to the cathode 12. The line 71 can be tangent to the open holes 65.

The focusing plate 62 can further comprise two additional holes 66, each bend along line 71 of each tab 64 aligned with one of the two additional holes 66. The additional holes 66 can make it easier to bend the tabs 64 along line 71. Following are example relationships between a smallest diameter $D_O$ of the two open holes 65 and a largest diameter $D_A$ of the two additional holes 66: $D_O/D_A \geq 1$, $D_O/D_A \geq 1.2$, $D_O/D_A \geq 1.5$, or $D_O/D_A \geq 2$; and $D_O/D_A \leq 2.5$, $D_O/D_A \leq 3.5$, $D_O/D_A \leq 5$, $D_O/D_A \leq 10$.

The focusing plate 62 can have a thickness $Th_P$ for sufficient focusing plate 62 structural strength, to allow bends in the tabs 64 along lines 71, and for improved shaping of the electron beam. Example thicknesses $Th_P$ of the focusing plate 62 include: $Th_P \geq 0.001$ mm, $Th_P \geq 0.005$ mm, or $Th_P \geq 0.01$ mm; and $Th_P \leq 0.1$ mm, $Th_P \leq 0.5$ mm, or $Th_P \leq 1$ mm.

Considerations for selection of materials of the focusing plate 62 include vacuum compatibility, malleability at room temperature, electrical conductivity, and a sufficiently high melting point to avoid focusing plate 62 recrystallization or melting by proximity to the filament $\mathbf{12}_F$. The focusing plate 62 can be metallic. Example materials of the focusing plate 62 include nickel, cobalt, iron, molybdenum, tantalum, niobium, steel, or combinations thereof.

The focusing plate 62 can be used on a transmission-target x-ray tube or a side-window x-ray tube. The focusing plate 62, as used above in alignment with the filament $\mathbf{12}_F$, can result in more consistent x-ray spot size and location in spite of the difficulty of repeated and precise placement of the filament $\mathbf{12}_F$.

A method of aligning an x-ray tube filament $\mathbf{12}_F$ with a focusing plate 62 can comprise some or all of the following steps, which can be performed in the following order or other order if so specified. There may be additional steps not described below. These additional steps may be before, between, or after those described. The focusing plate 62 can have other characteristics as described above this method section.

The method can comprise attaching the filament $\mathbf{12}_F$ to a cathode 12 (e.g. to electrodes 51); aligning an open channel 63 of the focusing plate 62 with a longitudinal dimension 52 of the filament $\mathbf{12}_F$; attaching the focusing plate 62 to the cathode 12 (attaching to a part of the cathode 12 electrically isolated from one or both of the pair of electrodes 51); and bending tabs 64 of the focusing plate 62 to align with a location of the filament $\mathbf{12}_F$, the tabs 64 bordering the open channel 63. The steps of the method can be performed in the order of the prior sentence.

Aligning the tabs 64 with the filament $\mathbf{12}_F$ can help focus the electron beam to create the desired focal shape. Bending the tabs 64 can include aligning the tabs 64 such that an imaginary plane 91, extending between an edge of the tabs 64 at the open channel 63, extends through the filament $\mathbf{12}_F$. The imaginary plane 91 can be perpendicular to an axis 41 (see FIG. 4) of the x-ray tube 40 extending between the filament $\mathbf{12}_F$ and a target material on the anode 11 or x-ray window 14. Attaching the filament $\mathbf{12}_F$ to the cathode 12 can include attaching the filament $\mathbf{12}_F$ across a pair of electrodes 51. Attaching the focusing plate 62 to the cathode 12 can include attaching the focusing plate 62 to a part of the cathode 12 electrically isolated from one of the pair of electrodes 51.

The open channel 63 of the focusing plate 62 can extend between two open holes 65 in the focusing plate 62. Aligning the open channel 63 of the focusing plate 62 can further comprise aligning the two open holes 65 with the pair of electrodes 51, each open hole 55 being aligned with one of the electrodes 51.

What is claimed is:

1. An x-ray tube comprising:

a cathode and an anode electrically insulated from one another;

an x-ray window, associated with the anode;

the cathode configured to emit electrons towards the x-ray window;

the x-ray window including a target material for generation of x-rays in response to impinging electrons from the cathode, the target material spread throughout the entire x-ray window;

the x-ray window includes ≥75 mass percent of a single element, the single element is molybdenum, rhodium, rhenium, or tungsten; and the x-ray window includes aluminum, potassium, and silicon.

2. An x-ray tube comprising:

a cathode and an anode electrically insulated from one another;

an x-ray window, associated with the anode;

the cathode configured to emit electrons towards the x-ray window;

the x-ray window including a target material for generation of x-rays in response to impinging electrons from the cathode, the target material spread throughout the entire x-ray window;

the x-ray window includes ≥75 mass percent tungsten; and the x-ray window includes lanthanum oxide.

3. An x-ray tube comprising:

a cathode and an anode electrically insulated from one another;

a focusing plate and a filament attached to the cathode, the focusing plate spaced apart from the filament;

an open channel of the focusing plate aligned with a longitudinal dimension of the filament; and tabs of the focusing plate bordering the open channel and bent to align with a location of the filament, such that an imaginary plane, extending between an edge of the tabs at the open channel, extends through the filament.

4. The x-ray tube of claim 3, further comprising:

an x-ray window, associated with the anode;

the cathode configured to emit electrons towards the x-ray window;

the x-ray window including a target material for generation of x-rays in response to impinging electrons from the cathode, the target material spread throughout the entire x-ray window;

the x-ray window includes ≥75 mass percent of a single element, the single element is molybdenum, rhodium, rhenium, or tungsten; and the x-ray window includes aluminum, potassium, and silicon.

5. The x-ray tube of claim 3, further comprising:

an x-ray window, associated with the anode;

the cathode configured to emit electrons towards the x-ray window;

the x-ray window including a target material for generation of x-rays in response to impinging electrons from the cathode, the target material spread throughout the entire x-ray window;

the x-ray window includes ≥75 mass percent of a single element, the single element is molybdenum, rhodium, rhenium, or tungsten; and 0.025 mm≤$Th_w$, where $Th_w$ is a thickness of the x-ray window.

6. The x-ray tube of claim 5, wherein $Th_w$≤0.2 mm.

7. The x-ray tube of claim 3, further comprising the open channel is a single open channel in the focusing plate and the filament is a single filament.

8. The x-ray tube of claim 3, wherein the filament is attached and electrically coupled to a pair of electrodes, and the focusing plate is attached to a part of the cathode electrically isolated from one of the pair of electrodes.

9. The x-ray tube of claim 8, further comprising two open holes in the focusing plate, the open channel extends between the two open holes, and each of the two open holes is aligned with one of the pair of electrodes.

10. The x-ray tube of claim 9, wherein 1.5≤$D_o$/W≤7, where $D_o$ is a smallest diameter of the two open holes and W is a width of the channel.

11. The x-ray tube of claim 9, wherein each tab of the focusing plate is bent along a line that is tangent to the open holes.

12. The x-ray tube of claim 11, wherein each line is aligned with a longitudinal dimension of the filament.

13. The x-ray tube of claim 11, further comprising two additional holes, each bend along the line of each tab is aligned with one of the two additional holes.

14. The x-ray tube of claim 13, wherein 1.5≤$D_o$/$D_A$≤3.5, where $D_o$ is a smallest diameter of the two open holes, and $D_A$ is a largest diameter of the two additional holes.

15. The x-ray tube of claim 3, wherein the tabs of the focusing plate are aligned with a longitudinal dimension of the filament.

16. The x-ray tube of claim 3, wherein 0.001 mm≤$Th_p$≤1 mm, where $Th_p$ is a thickness of the focusing plate.

17. The x-ray tube of claim 3, wherein 0.01 mm≤$Th_p$ 0.1 mm, where $Th_p$ is a thickness of the focusing plate.

18. The x-ray tube of claim 3, wherein the focusing plate comprises nickel, cobalt, iron, molybdenum, tantalum, niobium, steel, or combinations thereof.

* * * * *